US007412837B2

(12) United States Patent
Karlsson et al.

(10) Patent No.: US 7,412,837 B2
(45) Date of Patent: Aug. 19, 2008

(54) METHOD FOR USE IN CONTROLLING AN ABSORPTION REFRIGERATING SYSTEM, AND AN ABSORPTION REFRIGERATOR

(75) Inventors: Arne Karlsson, Motala (SE); Carl Lindhagen, Motala (SE); Fredrik Reithe, Linköping (SE)

(73) Assignee: Dometic Sweden AB, Solna (SE)

( * ) Notice: Subject to any disclaimer, the term of this patent is extended or adjusted under 35 U.S.C. 154(b) by 361 days.

(21) Appl. No.: 11/360,086

(22) Filed: Feb. 23, 2006

(65) Prior Publication Data

US 2007/0193286 A1 Aug. 23, 2007

(51) Int. Cl.
*F25B 1/00* (2006.01)

(52) U.S. Cl. ..... 62/115; 62/148

(58) Field of Classification Search ..... 62/115, 62/143, 147, 148, 155, 158, 166, 167, 168, 62/125, 126, 127, 141, 476–481, 264; 236/51, 236/78 D, 94; 337/301, 302, 303; 340/584, 340/585, 588; 700/299, 300
See application file for complete search history.

(56) References Cited

U.S. PATENT DOCUMENTS 4,955,208 A * 9/1990 Kawashima et al. ..... 62/264
5,138,846 A * 8/1992 Ogawa et al. ..... 62/148
5,156,013 A * 10/1992 Arima et al. ..... 62/148
5,224,352 A * 7/1993 Arima et al. ..... 62/141
5,697,225 A * 12/1997 Wada ..... 62/148
5,768,898 A * 6/1998 Seok et al. ..... 62/132
5,934,088 A * 8/1999 Takeda ..... 62/127
6,000,232 A * 12/1999 Witten-Hannah et al. ..... 62/89
6,378,315 B1 * 4/2002 Gelber et al. ..... 62/80
6,523,358 B2 * 2/2003 Collins ..... 62/156
6,739,146 B1 * 5/2004 Davis et al. ..... 62/155
7,050,888 B2 * 5/2006 Schneider et al. ..... 700/300
2005/0115251 A1 6/2005 Karlsson et al.
2005/0115252 A1 6/2005 Karlsson et al.

FOREIGN PATENT DOCUMENTS

WO WO 03/072378 9/2003
WO WO 2005/002040 1/2005
WO WO 2005/003653 1/2005

* cited by examiner

*Primary Examiner*—Mohammad M Ali
(74) *Attorney, Agent, or Firm*—Pearne & Gordon LLP

(57) ABSTRACT

The invention relates to a method for controlling a running time of an absorption refrigerating system of an absorption refrigerator, which absorption refrigerator comprises two differently tempered refrigerator compartments. The method comprises the steps of: monitoring the temperature in a first compartment; activating the refrigerating system when the temperature sensed in the first compartment exceeds a predetermined value; de-activating the refrigerating system when a cut-out temperature is reached; monitoring the time period during which the absorption refrigerating system is turned off; and supplying heat to the first refrigerator compartment, when the time period exceeds a predetermined time period. The invention also relates to a microcontroller, computer program product and to an absorption refrigerator comprising means for performing the inventive method.

13 Claims, 2 Drawing Sheets

METHOD FOR USE IN CONTROLLING AN ABSORPTION REFRIGERATING SYSTEM, AND AN ABSORPTION REFRIGERATOR

FIELD OF THE INVENTION

The invention relates to a method for controlling a running time of an absorption refrigerating system as defined in the preamble of claim 1. The invention also relates to a microcontroller implementing said method and to a computer program product stored on a computer readable storage medium. The invention further relates to an absorption refrigerator comprising a control function for performing such method.

BACKGROUND OF THE INVENTION

House trailers are a popular choice for recreation and holiday activity enabling people to travel around and at the same time have a familiar and comfortable housing environment. Many trailers comprise most of modern conveniences, such as for example a shower, dishwasher, cooking means and refrigerator.

A suitable choice of refrigerator for mobile use, for example in such recreation vehicles or in sailing boats, is an absorption refrigerator. An absorption refrigerator usually comprises a freezer compartment maintaining a temperature at approximately −18° C. and a fresh food compartment or refrigerator compartment maintaining a temperature at approximately +5° C. Briefly, an absorption refrigerator comprises an absorption refrigerating system including a condenser, a heater, an evaporator and an absorption vessel. In the evaporator a refrigeration medium, usually ammonia gas, flows from an upstream end to a downstream end. The evaporator comprises a first tube section arranged to absorb heat from the freezer compartment and a second tube section arranged to absorb heat from the fresh food compartment, thereby lowering the temperature within the compartments.

SUMMARY OF THE INVENTION

An absorption refrigerator further comprises a thermostat control function that causes the refrigerating system to be switched on when the temperature as sensed in the fresh food compartment is too high. The refrigerating system then runs during a certain running time until the temperature is adequate, after which the refrigerating system is switched off. The single refrigerating system cools both the refrigerator compartment and the freezer based on the temperature of the fresh food compartment.

An absorption refrigerator is often in use all the year round, and may thus be subject to large temperature variations if the vehicle or other installation locations in which the refrigerator is installed is exposed to such temperature variations. In particular, the temperature performance of the absorption refrigerator may deteriorate under certain circumstances. The performance is for example affected if the ambient temperature is too low. For example, people often leave their vehicle unutilized during some part of the year, e.g. during winter, while still leaving the absorption refrigerator in operation for storing food until next time of use. If, in view of the above-described running time of the refrigerator, the trailer is left at a low ambient temperature, the period of time that the refrigerator is run will be reduced, resulting in the freezer compartment becoming warmer.

A difficulty encountered in an all the year round use of an absorption refrigerator is thus the detrimental influence that the ambient temperature may have on the dual functioning of the refrigerator. Particularly the fact that the running time of the refrigerator is determined by the temperature of the fresh food compartment, which running time is possibly not long enough to keep the freezer at a suitable temperature, but only suitable for keeping the fresh food compartment at a suitable temperature.

The present invention is aimed at providing an apparatus and method addressing the above problems.

It is an object of the invention to provide a control function device for use in an absorption refrigerator enabling a maintained performance irrespective of the ambient conditions, and in particular irrespective of the ambient temperature.

It is a further object of the invention to provide a control function device bringing to the absorption refrigerator an improved all around the year functionality.

It is a further yet object of the invention to provide a control function device that increases the reliability of the absorption refrigerator.

In accordance with the invention, a method for controlling the running time of an absorption refrigerating system of an absorption refrigerator is provided. The absorption refrigerator comprises two differently tempered refrigerator compartments. The method comprises the steps of: monitoring the temperature in a first compartment; activating the refrigerating system when the temperature sensed in the first compartment exceeds a predetermined value; de-activating the refrigerating system when a cut-out temperature is reached; monitoring the time period during which the absorption refrigerating system is turned off; and supplying heat to the first refrigerator compartment, when the time period exceeds a predetermined time period. By means of the inventive method the fresh food compartment of the absorption refrigerator is heated in order to activate the absorption refrigerating system or cooling system of the refrigerator. Further, by means of the invention it is ensured that the temperature of the freezer compartment does not become too high at low ambient temperatures. The method is suitable for use in an absorption refrigerator and enables a maintained performance irrespective of the ambient conditions, and in particular irrespective a low ambient temperature. Further, by means of the invention an improved all around the year functionality is brought to the absorption refrigerator increasing the reliability of the it.

In accordance with an embodiment of the invention the step of supplying heat comprises switching on a light source arranged in the first refrigerator compartment. Thereby the lamp for interior light, commonly provided in refrigerators, may be utilised in the inventive method. The heat load is switched on a certain period of time after the refrigerating system has been switched off by a thermostat function of the refrigerator. The heat load is switched off when the temperature in the fresh food compartment has become equal to the cut-in level for the thermostat function, thus enforcing the cooling system to be switched on when it has been off during a predetermined period of time. In an alternative embodiment, the step of supplying heat comprises switching on a heating element arranged in the first refrigerator compartment. A separate heating element may thus alternatively be used, enabling a specially designed heating element or a commonly used light source to be used and thereby providing design flexibility.

In accordance with another embodiment of the invention, the predetermined time period before the first refrigerator compartment is heated is within the range of 20-60 minutes, and preferably about 35 minutes. This is a suitable time period for preventing the temperature in the freezer compartment from becoming too high.

The present invention also relates to a control function for controlling the running time of the absorption refrigerating system and to an absorption refrigerator comprising means for performing such control function, whereby advantages corresponding to the above described are achieved.

DETAILED DESCRIPTION OF THE PREFERRED EMBODIMENTS

Figure 1:
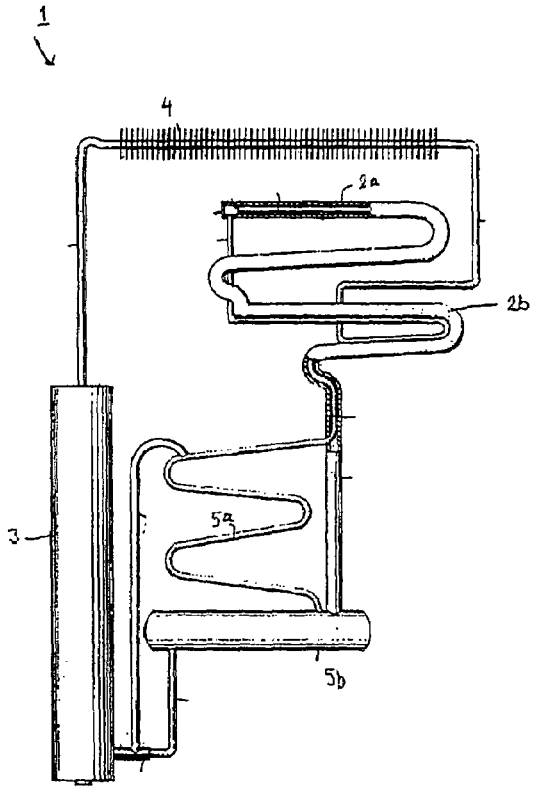
FIG. 1 illustrates an absorption refrigerating system.

FIG. 1 illustrates an absorption refrigerating system 1 having an above mentioned evaporator unit divided in two sections 2*a*, 2*b*, one section 2*a* cooling the freezer compartment of an absorption refrigerator and another section 2*b* cooling the food storage space or fresh food compartment. A boiler 3 heats a refrigerant solution and vaporized refrigerant, preferably ammonia gas, passes upward through a conduit into a condenser 4, in which the refrigerant is condensed and liquefied, for example to liquid ammonia. The liquid refrigerant flows from the condenser 4 through a conduit into the evaporator sections 2*a*, 2*b*. In these evaporator sections 2*a*, 2*b* the refrigerant evaporates and diffuses into an inert gas, such as for example hydrogen, giving a refrigerating effect and abstracting heat from the surroundings, i.e. from the freezer and the fresh food compartment. The resulting gas mixture of refrigerant and inert gas flows from evaporator section 2*b* through a conduit into an absorber 5. In the absorber 5 the refrigerant vapour is absorbed into a liquid absorbent such as for example water. The hydrogen or inert gas, which is practically insoluble and weak in refrigerant, is returned to evaporator sections 2*a*, 2*b*, while absorption liquid enriched in the absorber flows from the absorber through a conduit to the boiler, thus completing a cycle.

Figure 2:
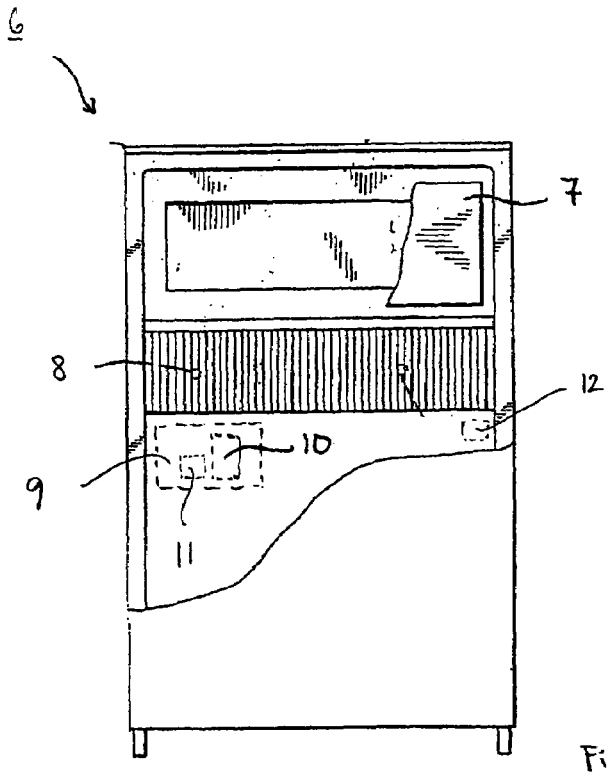
FIG. 2 illustrates schematically an absorption refrigerator comprising two compartments in which the present invention can be implemented.

FIG. 2 illustrates schematically an absorption refrigerator comprising differently tempered compartments and in which the present invention may be implemented. The absorption refrigerator 6 comprises an absorption refrigerating system 1 as described with reference to FIG. 1. The absorption refrigerator 6 comprises a cabinet including a rear wall, two sidewalls, a top wall and a bottom wall. These outer walls, together with one or two front doors enclose the freezer compartment or low temperature storage compartment and the fresh food compartment or higher temperature storage compartment. As is well known, the outer walls and the front door(s) all preferably include an outer and an inner shell between which heat-insulating material, such as polyurethane is arranged. The two compartments 7, 8 are hermetically sealed from each other by means of a partition wall. The above-described absorption refrigerating system 1 is arranged at the back of the cabinet. The absorption refrigerating system 1 (not shown in FIG. 2) cools the freezer compartment 7 as well as the fresh food compartment 8.

The absorption refrigerator 6 comprises electronic circuits implementing, among other things, a thermostat function that causes the refrigerating system 1 to be switched on when the temperature as sensed in the fresh food compartment 8 is too high. The electronics of the absorption refrigerator 6 is schematically indicated in FIG. 2 by reference numeral 9. The refrigerating system 1 then runs for a specified running time until an adequate temperature is again reached. Thereafter the refrigerating system 1 is switched off. The single, integral one-piece refrigerating system 1 cools both the fresh food compartment 8 and the freezer compartment 7 based on the temperature sensed in the fresh food compartment 8. It is thus not possible to control the temperature in the respective compartments independently and the temperature of the freezer compartment 7 will depend on the start and stop of the refrigerating system 1, i.e. its running time. The start of the refrigerating system 1 is determined by cut-in value settings of the electronics 9 and software implementing different functions and the stop of the refrigerating system 1 is determined by cut-out value settings.

The inventors of the present invention have realized that there are shortcomings in the performance of the prior art absorption refrigerator. As described earlier, since the temperature of the fresh food compartment 8 determines the running time of the refrigerating system 1, the temperature of the freezer compartment 7 may occasionally become too high. That is, if the running time of the refrigerating system 1 is too short the cooling of the freezer compartment 7 may be inadequate.

In accordance with the present invention a control function is added to the electronics controlling the absorption refrigerator 6 for overcoming this shortcoming. The electronics 9 comprises a thermostat or temperature control, i.e. a device 10 the function of which is to keep a certain temperature within the absorption refrigerator 6. Such thermostatic control or temperature control device 10 comprises temperature sensitive means, such as for example a temperature sensor or thermometer probe (not shown) and software programs suitable for executing related applications and algorithms. As mentioned earlier, this temperature sensor is preferably located in the fresh food compartment 8, thus sensing the temperature of this part of the absorption refrigerator 6.

In accordance with the invention, the electronics 9 and microcontroller or computer-on-chip controlling the electronics 9 comprises a control function 11 preventing the temperature in the freezer compartment 7 from becoming too high. In the following description this control function 11 is referred to as a low ambient control function. However, it is realised that the control function may be affected by other circumstances as well. For example, the time period before a heat load is turned on may be adjustable and variable by the user, or an external temperature sensor could be used as input for determining when to turn on the heat load.

As explained earlier, the thermostatic control device 10 may sometimes be switched off during a too long period, for example if the ambient temperature of the absorption refrigerator 6 is relatively low, such as a few degrees Celsius (e.g 2-5° C.). If the thermostatic control device 10 of the absorption refrigerator 6 is switched off during more than a certain, predetermined time, for example 35 minutes, the low ambient control function 11 in accordance with the invention is executed in order to provide a heat input or supply of heat. This heat input may for example be accomplished by turning on a light source, indicated in FIG. 2 by reference numeral 12. Such light source 12, for example a lamp for interior light, is conventionally included in most absorption refrigerators and normally turned on when the user opens the refrigerator door. It is realised that other means for accomplishing a supply of heat may be utilized, for example one or more separate heating elements placed in the fresh food compartment 8.

When the heat supply, for example the light 12, has heated the fresh food compartment 8 sufficiently, i.e. to a temperature that is too high and typically above +5° C., the absorption refrigerating system 1 is switched on or activated and is thereby cooling both the fresh food compartment 8 and the freezer compartment 7. The absorption refrigerating system 1 is thus forced to be activated when the time period during which it is turned off exceeds a certain period of time.

The absorption refrigerating system 1 is thus switched on both as determined by means of the thermostatic control device 10, and in addition, as a safety function, as determined by the innovative low ambient control function 11.

In accordance with the invention, a heat supply is effectuated when the thermostatic control device 10 of the absorption refrigerator 6 has been turned off during a certain, preferably predetermined, period of time. The switching on and switching off of the heat supply is determined by a preset time period during which the refrigerating system 1 is turned off. The low ambient control function 11 in accordance with the present invention thus provides an added security to the absorption refrigerator, ensuring that the temperature in the freezer does not become too high. The user may thus use the absorption refrigerator in any surrounding, that is, without considering the ambient temperature, whereby the performance of the absorption refrigerator is increased.

The inventive control function added to the improved absorption refrigerator in accordance with the invention is preferably implemented in a microcontroller programmable by means of control software, i.e. the control function is an ordered sequence of instructions for changing the state of the refrigerator electronics hardware in a particular sequence. The microcontroller is used for controlling the electronics of the refrigerator, and the microcontroller implementing the control function is preferably installed during the manufacturing of the absorption refrigerator.

However, in an alternative embodiment the control function may be implemented by means of circuit components, for example a timer circuit.

The invention also relates to a computer program product stored on a computer readable storage medium, such as a ROM (Read-only memory), PROM (programmable read-only memory), EPROM (Erasable PROM), Flash, EEPROM (Electrically Erasable PROM), SRAM (Static RAM), DRAM (Dynamic RAM). The computer program product comprises computer readable program code for causing electronics controlling the absorption refrigerator to perform the steps of the method in accordance with the invention.

Figure 3:
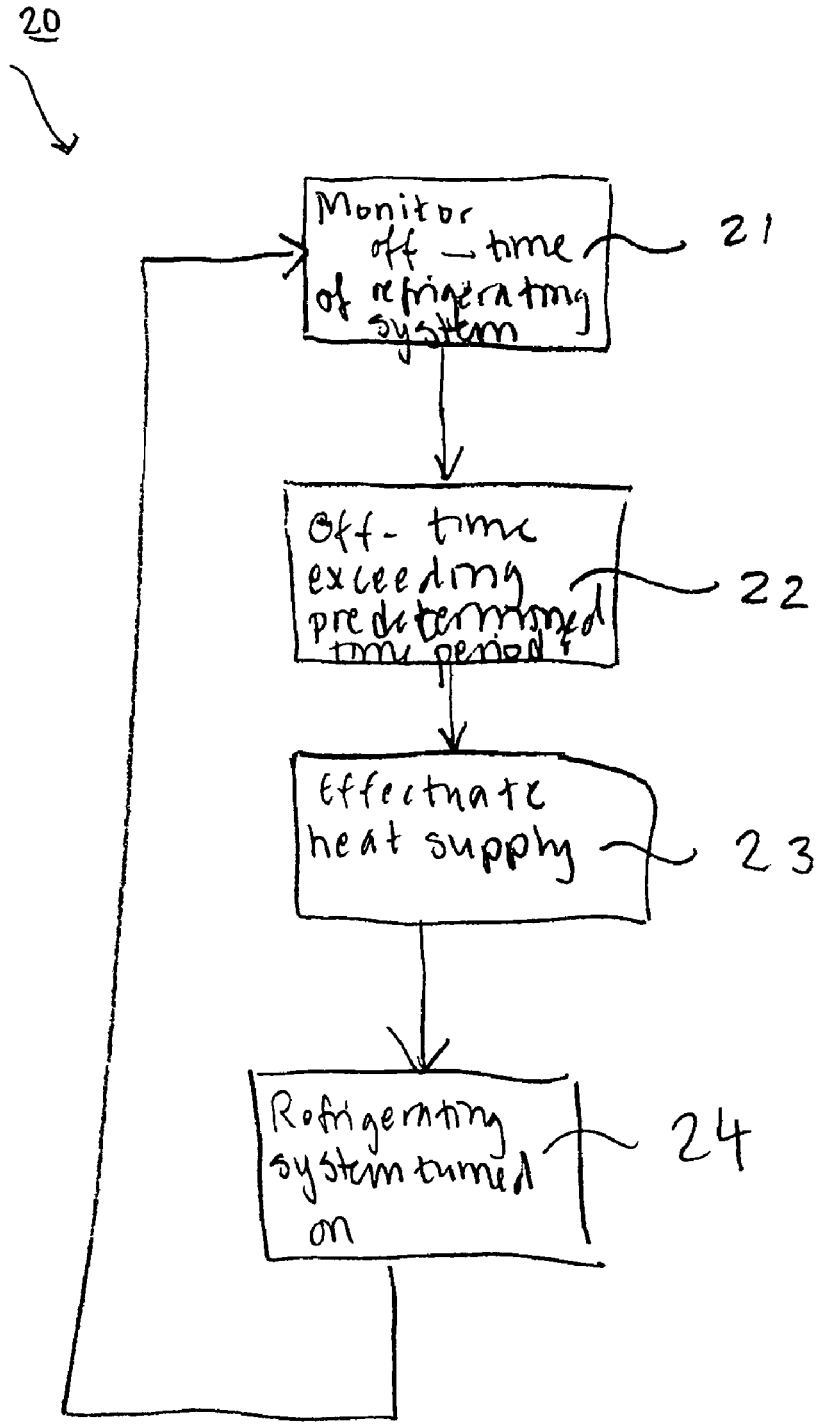
FIG. 3 is a flow chart over the steps included in an embodiment of the invention.

FIG. 3 is a flow chart over the steps included in an embodiment of a method for controlling the running time of the refrigerating system 1 of an absorption refrigerator 6, in accordance with the invention. The method 20 comprises a first step (step 21) in which the switching on and off of the absorption refrigerating system is monitored, and in particular the off time or idle time during which the absorption refrigerating system 1 of the absorption refrigerator 6 is turned off. When it is determined, in step 22, that the absorption refrigerator has been turned off during a predetermined period of time, for example 20-60 minutes and preferably 35 minutes, the low ambient control function 11 is, in step 23, effectuating heat to be supplied to the fresh food compartment. This can for example be accomplished by turning on a light source 12. When the temperature sensor of the fresh food compartment indicates a too high temperature, the refrigerating system 1 is turned on in step 24. The method then returns to step 21, wherein the running time of the refrigerating system 1 is again monitored.

In summary, in accordance with the present invention a function is provided for heating the fresh food compartment of the absorption refrigerator for turning on the absorption refrigerating system or cooling system of the refrigerator. The heat load is switched on a certain period of time after the cooling unit has been switched off by the thermostat function. The heat load is switched off when the temperature in the fresh food compartment has become equal to the cut-in level for the thermostat function, thus enforcing the cooling system to be switched on when it has been off for a certain period of time. By means of the invention it is ensured that the temperature of the freezer compartment does not become too high, which may be the case for example at low ambient temperatures. Thereby a control function is provided for use in an absorption refrigerator enabling a maintained performance although the ambient temperature is low, and in particular it is ensured that the temperature of the freezer compartment does not become too high at such low ambient temperatures. Further, the control function brings an improved all around the year functionality to the absorption refrigerator increasing the reliability of the absorption refrigerator.

The invention claimed is:

1. A method for controlling a running time of an absorption refrigerating system of an absorption refrigerator, which absorption refrigerator comprises two differently tempered refrigerator compartments, said method comprising the steps of:

monitoring the temperature in a first refrigerator compartment, activating said refrigerating system when the temperature sensed in said first refrigerator compartment exceeds a predetermined value, de-activating said refrigerating system when a cut-out temperature is reached, monitoring the time period during which said absorption refrigerating system is turned off, and supplying heat to said first refrigerator compartment, when said time period exceeds a predetermined time period.

2. The method as claimed in claim 1, wherein said steps are performed repeatedly.

3. The method as claimed in claim 1, wherein said step of supplying heat comprises switching on a light source arranged in said first refrigerator compartment.

4. The method as claimed in claim 1, wherein said step of supplying heat comprises switching on a heating element arranged in said first refrigerator compartment.

5. The method as claimed in claim 1, wherein said predetermined time period is within the range of 20-60 minutes, preferably about 35 minutes.

6. The control device as claimed in claim 5, wherein said predetermined time period is within the range of 20-60 minutes, preferably about 35 minutes.

7. A low ambient temperature control device for use in an absorption refrigerator for controlling a running time of an absorption refrigerating system of the absorption refrigerator, which absorption refrigerator comprises two differently tempered refrigerator compartments, and means for activating said refrigerating system when a temperature sensed in a first refrigerator compartment exceeds a predetermined value, the control device comprising:

means for monitoring the time period during which said absorption refrigerating system is turned off and means for supplying heat to said first refrigerator compartment, when said time period exceeds a predetermined time period.

8. The control device as claimed in claim 7, wherein said means for supplying heat comprises means for switching on a light source within said first refrigerator compartment (8).

9. The control device as claimed in claim 7, wherein said means for supplying heat comprises means for switching on a heating element.

10. An absorption refrigerator comprising a low ambient temperature control function for controlling a running time of an absorption refrigerating system of the absorption refrigerator, which absorption refrigerator comprises two differently tempered refrigerator compartments and means for activating said refrigerating system when a temperature sensed in a first refrigerator compartment exceeds a predetermined value, the low ambient temperature control function arranged for performing the steps of:

monitoring the temperature in a first refrigerator compartment, activating said refrigerating system when the temperature sensed in said first refrigerator compartment exceeds a predetermined value, de-activating said refrigerating system when a cut-out temperature is reached, monitoring the time period during which said absorption refrigerating system is turned off, and supplying heat to said first refrigerator compartment, when said time period exceeds a predetermined time period.

11. An absorption refrigerator comprising a refrigerating system and two differently tempered refrigerator compartments and means for activating said refrigerating system when a temperature sensed in a first refrigerator compartment exceeds a predetermined value, the absorption refrigerator further comprising:

means for monitoring the temperature in a first refrigerator compartment, means for activating said refrigerating system when the temperature sensed in said first refrigerator compartment exceeds a predetermined value, means for de-activating said refrigerating system when a cut-out temperature is reached, means for monitoring the time period during which said absorption refrigerating system is turned off, and means for supplying heat to said first refrigerator compartment, when said time period exceeds a predetermined time period.

12. A microcontroller for controlling a running time of an absorption refrigerating system of an absorption refrigerator, which absorption refrigerator comprises two differently tempered refrigerator compartments, the microcontroller comprising means for performing the steps of:

monitoring the temperature in a first refrigerator compartment, activating said refrigerating system when the temperature sensed in said first refrigerator compartment exceeds a predetermined value, de-activating said refrigerating system when a cut-out temperature is reached, monitoring the time period during which said absorption refrigerating system is turned off and supplying heat to said first refrigerator compartment, when said time period exceeds a predetermined time period.

13. A computer program product stored on a computer readable storage medium, comprising computer readable program code for causing electronics controlling an absorption refrigerator, which absorption refrigerator comprises an absorption refrigerating system and two differently tempered refrigerator compartments, to perform the following steps:

monitor the time period during which said absorption refrigerating system is turned off and supply heat to said first refrigerator compartment, when said time period exceeds a predetermined time period.

* * * * *